United States Patent [19]

Lippold

[11] Patent Number: 4,735,282

[45] Date of Patent: Apr. 5, 1988

[54] DEVICE AND CIRCUIT FOR THE GENERATION OF VORTEX RINGS

[76] Inventor: Andreas Lippold, Amselstrasse 2, D-6393 Wehrheim, Fed. Rep. of Germany

[21] Appl. No.: 917,992

[22] Filed: Oct. 10, 1986

[30] Foreign Application Priority Data

Oct. 24, 1986 [DE] Fed. Rep. of Germany ..... 3537856

[51] Int. Cl.[4] ..... H05K 5/00

[52] U.S. Cl. ..... 181/153; 446/24; 446/484

[58] Field of Search ..... 84/464 R; 116/214; 446/24, 484; 352/85; 181/153

[56] References Cited

U.S. PATENT DOCUMENTS

| | | | |
|---|---|---|---|
| 1,863,167 | 6/1932 | Rode | 446/24 |
| 2,788,607 | 4/1957 | Ward | 446/24 |
| 3,372,873 | 3/1968 | Weiss et al. | 446/24 X |
| 3,750,838 | 8/1973 | Pyle, Jr. | 181/153 |

*Primary Examiner*—L. T. Hix
*Assistant Examiner*—Brian W. Brown
*Attorney, Agent, or Firm*—Karl F. Ross; Herbert Dubno

[57] ABSTRACT

A device for the generation of vortex rings which consists of a box supplied with orifices and electromechanic transformers. The electromechanic transformers are controlled by signalers and cause pressure waves within the box which form vortex rings at the orifices. As signalers low-frequency amplifiers can be used which send out music or speech signals or electronic circuits which form a kind of optimized signal.

5 Claims, 3 Drawing Sheets

DEVICE AND CIRCUIT FOR THE GENERATION OF VORTEX RINGS

FIELD OF THE INVENTION

The invention relates to the electromagnetically controlled generation of vortex rings. Their visualization is achieved by means of smoke, condensed steam, visible gases, small macroscopic particles such as styroporballs, and also with special lighting sources.

BACKGROUND OF THE INVENTION

Vortex rings are self-contained vortex-filaments which move at various speeds depending on their natural rotation and size and which possess a high dynamically conditioned geometric stability.

Devices for the generation of vortex rings are already known (see Westphal: "Physik", 1970, 25./26. Auflage, p. 161). These are manually operated and therefore it is not possible to determine the exact size, speed, and point of formation of the vortex.

OBJECT OF THE INVENTION

The object of the invention is to provide a system which can generate vortex rings which are exact and reproducible in size, speed, and point of formation at any given time, and, in addition, for control of vortex ring formation from a distant point.

According to the invention pressure waves are generated by means of an electromechanical transducer which is controlled by signals of a signaler, and preferably has a loudspeaker which is installed within a box in such a manner that movements of its diaphragm cause pressure waves within the box.

According to the invention, a device for the generation of vortex rings comprises a box supplied with one or more orifices. Pressure waves are generated through an electromechanical transducer (e.g. loudspeaker) on one side of the box. The electromechanic transformer is controlled by a signaler and generates pressure waves within the box that form vortex rings at the orifices.

Low-frequency amplifiers can be used as signalers. Signals originating from rhythmical music which are fed to the electromechanical transformer (e.g. loudspeaker) generate vortex rings synchronized with the music (bassdrum) and offer an unusually attractive optical appliance.

Electronic circuits which adjust the shape, intensity, and point of time of the control signal can also be employed as signalers.

This kind of signaler may also be triggered by music or speech in order to generate vortex rings in the music's rhythm but with a far higher optimization of the control signal.

If big bass loudspeakers are used as electromechanical transducers, it is possible to generate rings which are surprisingly fast and stable and which may even be felt.

BRIEF DESCRIPTION OF THE DRAWING

Further details of the invention are illustrated in the accompanying drawing in which.

SPECIFIC DESCRIPTION

Figure 1:
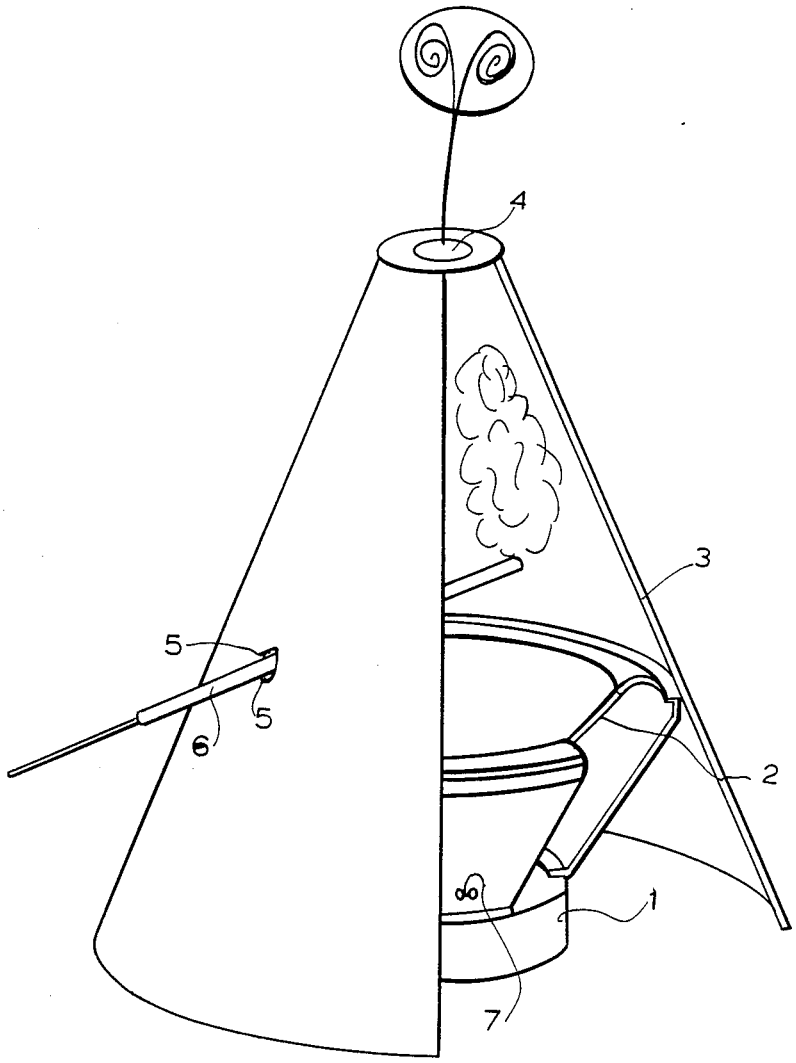
FIG. 1 is a diagrammatic section of a device with a conical setup for the generation of vortex rings.

FIG. 1 shows an apparatus for the generation of vortex rings using a loudspeaker 1 with a diaphragm 2. A conical enclosure 3 is hermetically mounted on top of the diaphragm; the orifice 4 on the top of the enclosure provides an exit for the emerging vortex rings. A hole 5 serves for inspection of smoke or something similar. In this case a burning joss stick 6 is inserted into the enclosure. The connections 7 serve to connect the signaler to the loudspeaker.

Figure 2:
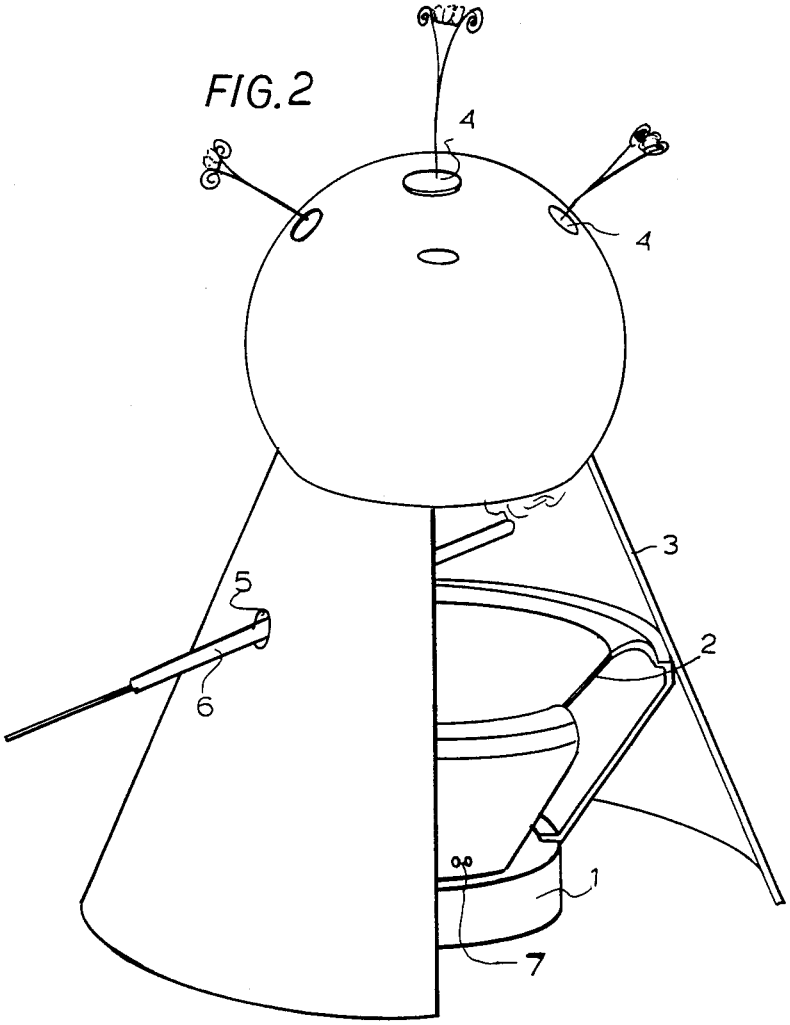
FIG. 2 is a diagrammatic perspective view of a device with a spherical setup.

FIG. 2 demonstrates a slightly different type embodiment. Here, the conical enclosure 3 is replaced by a frustocone, closed by a sphere 8 with several orifices 4.

Figure 3:
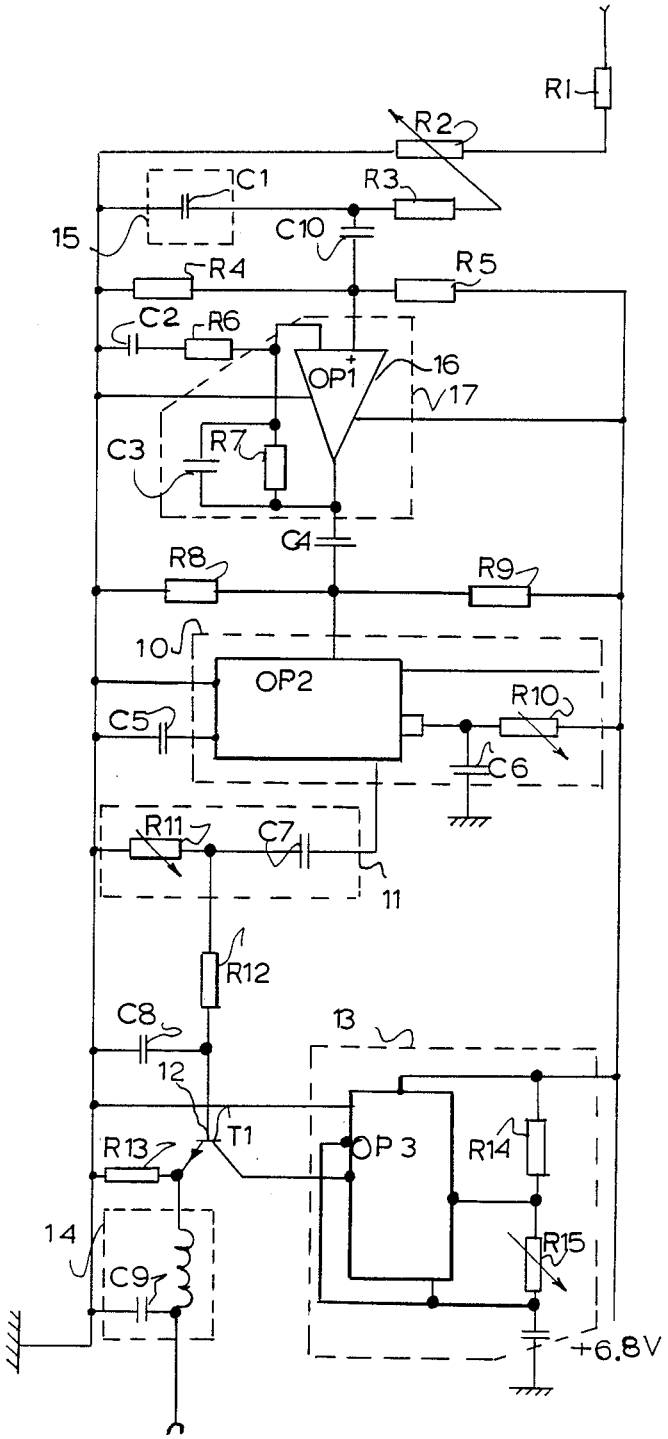
FIG. 3 is an electronic circuit for the generation of suitable signals.

FIG. 3 shows an electronic circuit which generates signals, suitable for vortex generation. Any given signal (speech, music etc.) is amplified in amplifier 16 and selected according to its frequency by an active low-pass filter 17 and thus reaches trigger unit 10. At certain input levels the output of the trigger unit switches to a logical "ONE" and thus opens the transistor T 1 which then transmits the rectangular and frequency-variable wave pulses from the oscillator 13 to the final LC-component 14. The period of dwell of the logical "ONE", caused by resistor trigger unit 10, is varied by R 10 and fades out exponentially depending on the RC-component 11. The transmitted pulse of T 1, that is the envelope for the signals of 13, shows a steep ascent and an exponential descent. This kind of signal prevents a collision among vortex rings because the first rings fly faster than the following ones.

The invention thus is a device for the generation of vortex rings which consists of a box with one or several orifices and an electromechanical transformer, built into one side of the box and controlled by specifiable electric signals. Vortex rings emerge in the signal's rhythm at the orifices and can be made visible by smoke, condensed steam etc. and also with the help of adapted lighting sources.

I claim:

1. A device for the generation of vortex rings, comprising:

a fructoconical enclosure formed at a narrow end thereof with means defining at least one orifice for emitting vortex rings;

a loudspeaker constituting an electromechanical transducer in said enclosure having an upper side provided with a diaphragm hermetically sealed to a wall of said enclosure for defining a space within said enclosure between said diaphragm and said orifice;

circuit means including a signal source and an amplifier connected between said signal source and said loudspeaker for applying signals to said loudspeaker to generate pressure waves in said space; and means for generating a suspension of visible particles in said space for propagation by said pressure waves from said orifice to form vortex rings of said visible particles.

2. The device defined in claim 1 wherein said circuit means includes as said source a source of music signals.

3. The device defined in claim 1 wherein said circuit means includes as said source a source of speech signals.

4. The device defined in claim 1 wherein said circuit means includes means for superimposing on said signal a low frequency exponentially decaying oscillation and means for varying a trigger threshold, frequency and time constant of said oscillation.

5. The device defined in claim 1 wherein said means defining at least one orifice comprises a spherical housing communicating with said enclosure and provided with a plurality of orifices each emitting vortex rings.

* * * * *

UNITED STATES PATENT AND TRADEMARK OFFICE

CERTIFICATE OF CORRECTION

PATENT NO. : 4,735,282

DATED : 5 April 1988

INVENTOR(S) : Andreas LIPPOLD

It is certified that error appears in the above-identified patent and that said Letters Patent is hereby corrected as shown below:

TITLE PAGE:

Item [30] Foreign Application Priority Data is to read:

-- Oct. 24, 1985 [DE] Fed. Rep. of Germany ...3537856 --.

Signed and Sealed this

Twenty-third Day of April, 1991

*Attest:*

HARRY F. MANBECK, JR.

*Attesting Officer*

*Commissioner of Patents and Trademarks*